US007609169B2

(12) United States Patent
Aiello

(10) Patent No.: US 7,609,169 B2
(45) Date of Patent: Oct. 27, 2009

(54) ELECTROMAGNETIC TELEMETRY APPARATUS AND METHODS FOR MINIMIZING CYCLICAL OR SYNCHRONOUS NOISE

(75) Inventor: Robert Anthony Aiello, Spring, TX (US)

(73) Assignee: Precision Energy Services, Inc., Fort Worth, TX (US)

( * ) Notice: Subject to any disclaimer, the term of this patent is extended or adjusted under 35 U.S.C. 154(b) by 623 days.

(21) Appl. No.: 11/468,868

(22) Filed: Aug. 31, 2006

(65) Prior Publication Data

US 2008/0068211 A1 Mar. 20, 2008

(51) Int. Cl.
*G01V 3/00* (2006.01)

(52) U.S. Cl. ..... 340/854.3; 324/333; 324/351; 340/854.6

(58) Field of Classification Search ..... 340/854.3, 340/854.6; 324/333, 351
See application file for complete search history.

(56) References Cited

U.S. PATENT DOCUMENTS 4,642,800 A 2/1987 Umeda
5,640,623 A * 6/1997 Sasaki ..... 396/180
6,246,962 B1 * 6/2001 Schultz et al. ..... 702/6
6,421,298 B1 * 7/2002 Beattie et al. ..... 367/83
6,657,597 B2 * 12/2003 Rodney et al. ..... 343/719
6,801,136 B1 * 10/2004 Goodman et al. ..... 340/854.3

FOREIGN PATENT DOCUMENTS

GB 2416463 A 1/2006
WO 03014525 A1 2/2003
WO 2004081494 A3 9/2004

* cited by examiner

*Primary Examiner*—Timothy Edwards, Jr.
(74) *Attorney, Agent, or Firm*—Wong, Cabello, Lutsch, Rutherford & Brucculeri, LLP

(57) ABSTRACT

An electromagnetic well borehole telemetry system for transmitting information between a downhole transceiver, disposed preferably within a borehole assembly in the borehole, and a surface transceiver positioned at or near the surface of the earth. A trigger and cooperating strobe are used to define strobe increments. Synchronous telemetry measurements made during the strobe increments are algebraically summed to identify a synchronous cyclical noise component in a composite electromagnetic telemetry signal. Any non cyclical noise components occurring during the strobe increments algebraically cancel in the algebraic summing operation. The cyclical noise component is then removed from the composite signal thereby increasing the signal to noise ratio of the telemetry system. The system is particularly effective in minimizing electromagnetic noise generated by the rotation of a rotating element such as the rotary table or top drive of a drilling rig.

15 Claims, 4 Drawing Sheets

$g_i = 360°$ $g_i = 45°$ $g_i = 720°$

FIG. 4
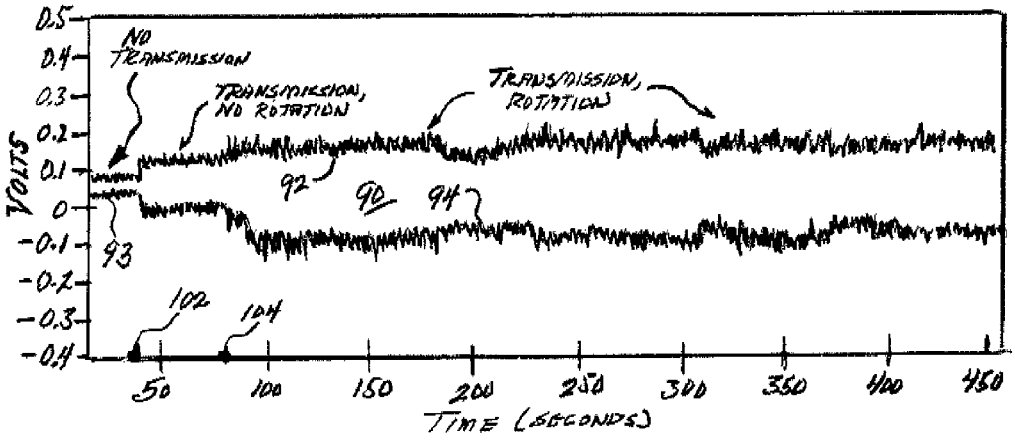
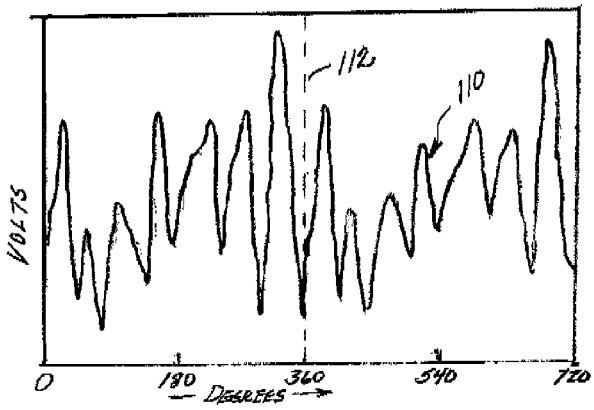
FIG 5
FIG 6
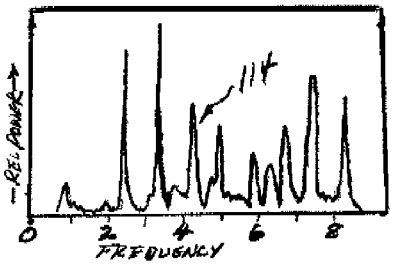
FIG. 8
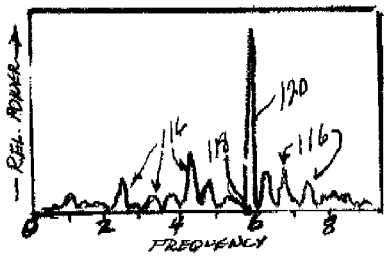

ELECTROMAGNETIC TELEMETRY APPARATUS AND METHODS FOR MINIMIZING CYCLICAL OR SYNCHRONOUS NOISE

This invention is directed toward an electromagnetic borehole telemetry system for transmitting information between a downhole transceiver and a transceiver preferably at the surface of the earth. More specifically, the invention is directed toward an electromagnetic telemetry system that uses synchronous time averaging to minimize cyclical or synchronous noise.

BACKGROUND OF THE INVENTION

The life of a typical hydrocarbon producing well can be broadly classified in three stages. The first stage includes the drilling of the well borehole, where it is desirable to measure properties of earth formations penetrated by the borehole and to steer the direction of the borehole while drilling. The second stage includes testing of formations penetrated by the borehole to determine hydrocarbon content and producibility. The third stage includes monitoring and controlling production typically throughout the life of the well. All stages typically employ a downhole assembly that contains one or more sensors responsive to stage related drilling, formation, or production parameters of interest. Response data from the one or more sensors are telemetered, via a first or "borehole" transceiver, to the surface of the earth. Response data are received by a second or "surface" transceiver for processing and interpretation. Conversely, it is desirable to transmit data via the surface transceiver to the downhole transceiver to control stage related drilling, testing or production operations.

In the stages discussed above, it is often not operationally feasible to use a "hard wire" communication link, such as one or more electrical or fiber optic conductors, between the downhole transceiver and the surface transceiver. This is especially true in the borehole drilling stage, where measures of parameters of formations penetrated by the borehole are of interest. When hard wire communication links are not feasible, electromagnetic (EM) telemetry systems offer one means for communicating between downhole and surface transceivers.

Systems for measuring geophysical and other parameters within the vicinity of a well borehole typically fall within two categories. The first category includes systems that measure parameters after the borehole has been drilled. These systems include wireline logging; tubing conveyed logging, slick line logging, production logging, permanent downhole sensing devices and other techniques known in the art. Memory type or hard wire communication links are typically used in these systems. The second category includes systems that measure formation and borehole parameters while the borehole is being drilled. These systems include measurements of drilling and borehole specific parameters commonly known as "measurement-while-drilling" (MWD), measurements of parameters of earth formation penetrated by the borehole commonly known as "logging-while-drilling" (LWD), and measurements of seismic related properties known as "seismic-while-drilling" or (SWD). For brevity, systems that measure parameters of interest while the borehole is being drilled will be referred to collectively in this disclosure as "MWD" systems. Within the scope of this disclosure, it should be understood that MWD systems also include logging-while-drilling and seismic-while-drilling systems.

A MWD system typically comprises a borehole assembly operationally attached to a downhole end of a drill string. The borehole assembly typically includes at least one sensor for measuring at least one parameter of interest, an electronics element for controlling and powering the sensor, and a downhole transceiver for transmitting sensor response to the surface of the earth for processing and analysis. The borehole assembly is terminated at the lower end with a drill bit. A rotary drilling rig is operationally attached to an upper end of the drill string. The action of the drilling rig rotates the drill string and borehole assembly thereby advancing the borehole through the action of the rotating drill bit. A surface transceiver is positioned remote from the borehole assembly and typically in the immediate vicinity of the drilling rig. The surface transceiver receives telemetered data from the downhole transceiver. Received data are typically processed using surface equipment, and one or more parameters of interest are recorded as a function of depth within the well borehole thereby providing a "log" of the one or more parameters. Hard wire communication links between the downhole and surface transceivers are operationally difficult because the borehole assembly containing the downhole transceiver is rotated by the drill string with respect to the surface transceiver.

In the absence of a hard wire link, several techniques can be used as a communication link for the telemetry system. These systems include drilling fluid pressure modulation or "mud pulse" systems, acoustic systems, and electromagnetic systems.

Using a mud pulse system, a downhole transmitter induces pressure pulses or other pressure modulations within the drilling fluid used in drilling the borehole. The modulations are indicative of one or more parameters of interest, such as response of a sensor within the borehole assembly. These modulations are subsequently measured typically at the surface of the earth using a receiver means, and one or more parameters of interest are extracted from the modulation measurements.

A downhole transmitter of an acoustic telemetry induces amplitude and frequency modulated acoustic signals within the drill string. The signals are indicative of one or more parameters of interest. These modulated signals are measured typically at the surface of the earth by an acoustic receiver means, and the one or more parameters of interest are extracted from the measurements.

Electromagnetic telemetry systems can employ a variety of techniques. Using one technique, electromagnetic signals are modulated according to a sensor response to represent one or more parameters of interest. In one embodiment, these signals are transmitted from a downhole EM transceiver, through intervening earth formation, and detected as a voltage or a current using a surface transceiver that is typically located at or near the surface of the earth. The one or more parameters of interest are extracted from the detected signal. Using another electromagnetic technique, a downhole transceiver creates a current within the drill string, and the current travels along the drill string. This current is typically created by imposing a voltage across a non-conducting section in the downhole assembly. The current is modulated according to the sensor response to represent the one or more parameters of interest. A voltage between the drilling rig and a remote ground is generated by the current and is measured by a surface transceiver, which is at the surface of the earth. The voltage is usually between a wire attached to the drilling rig or casing at the surface and a wire that leads to a grounded connection remote from the rig. Again, one or more parameters of interest are extracted from the measured voltage. Alternately, the one or more parameters of interest can be extracted from a measure of current.

The rotation of the drill string produces electromagnetic interference or electromagnetic "noise" in previously discussed EM telemetry systems. This noise can greatly degrade the signal of an electromagnetic telemetry system. The noise is typically cyclical or "synchronous" thereby mimicking the repetitive action of the rotating drill string. Electromagnetic noise can also be produced by the action of the drilling rig mud pump. This noise is also typically cyclical mimicking the repetitive action of the mud pump. There can be other sources of typically cyclical electromagnetic noise induced in an electromagnetic telemetry system. These sources include electric motors in the vicinity of the drilling rig, overhead wires transmitting alternating electric current, and any number and types of electromechanical apparatus found at a drilling site.

To summarize, noise from any source greatly degrades the signal of any type of electromagnetic telemetry system. This is especially true in "first stage" discussed above, which includes the drilling of the borehole using MWD systems using electromagnetic telemetry systems. The "second stage" discussed above includes testing of formations penetrated by the borehole to determine hydrocarbon content and producibility. If an electromagnet telemetry system rather than hardwired telemetry systems is used, noise degradation can again be a significant problem. Finally, the "third stage" discussed above includes monitoring and controlling production typically throughout the life of the well. These monitor and control systems can utilize electromagnetic rather than hardwired telemetry systems. Again, noise degradation in electromagnetic telemetry systems can be significant. Noise encountered in all three stages is often cyclical or synchronous, and can result from drill string rotation, the action of pumps, the operation of electric motors, electromagnetic radiation from nearby power lines, cyclical radio beacon signal, and the like.

SUMMARY OF THE INVENTION

This present invention is directed toward an electromagnetic (EM) well borehole telemetry system for transmitting information between a "downhole" EM transceiver, disposed preferably within a borehole assembly in the borehole, and a "surface" EM transceiver positioned at or near the surface of the earth. The system comprises apparatus and methods for removing cyclical or synchronous noise thereby enhancing the telemetry signal to noise ratio.

Synchronous time averaging (STA) is used to identify cyclical noise in an electromagnetic telemetry signal. This signal, which comprises a component representative of a sensor response and a noise component, will hereafter be referred as the "composite" signal. The noise component can comprise both cyclical and non cyclical noise components. A strobe is triggered by a cooperating trigger, responsive to a stimulus, to record, during a predetermined "strobe increment", a plurality of "increment composite noise signals". The stimulus can be a switch, reflector, magnet, protrusion, indention, time signal, or any suitable means to operate the trigger and cooperating strobe. These increment composite noise signals are algebraically summed. Any non cyclical components occurring during the strobe increment will algebraically cancel in the summing operation. Any cyclical noise occurring during the strobe increment and in synchronization with the strobe increment will be emphasized by the algebraic summing. The trigger-strobe-summing methodology produces a signature or "picture" of any cyclical noise component occurring synchronously with the strobe increment. This noise component is then combined with the measured composite signal to remove, or to at least minimize, cyclical noise thereby increasing the signal to noise ratio of the electromagnetic telemetry system.

Strictly speaking, the technique is not limited to time averaging. Strobe increments can be defined in units of degrees of an arc as well as an increment of time. In the former case, the process would comprise "arc" averaging rather than "time" averaging. For purposes of discussion, the averaging process will be generally referred to as STA.

The STA noise reduction system has widespread applications. The system is particularly effective in minimizing electromagnetic noise generated by the rotation of a rotary table or top drive of a drilling rig. A rotary table will be used for purposes of illustration and discussion. Embodied for this task, the strobe and cooperating trigger are controlled by the rotation of the rotary table. More specifically, the strobe increment is initiated and terminated by the rotational passage of stimuli comprising predetermined azimuth points on the rotary table. In this embodiment, the strobe increment is in degrees, and can comprise a partial arc of the rotary table or even multiple rotations of the rotary table. As an example, the strobe increment can be a single rotation of the rotary table. Stated mathematically, the strobe increment is initiated by the trigger at an azimuth $\theta_1$ and terminated at an azimuth $\theta_2$, where $\theta_2-\theta_1=360$ degrees.

The STA noise reduction system can also be used to reduce adverse effects of other cyclical noised. As another example, noise from the rig's mud pump can be reduced by triggering the strobe at the operating frequency, or at multiples of the operating frequency, of the mud pump. In this embodiment, the trigger typically cooperates with a clock that is synchronized with the period of the pump. That is, the trigger responds to a stimulus signal generated by the clock. The strobe increment is, therefore, in units of time rather than in units of degrees as in the previous rotary table example.

To summarize, the STA methodology can be used to reduce essentially any type of cyclical noise in an electromagnetic telemetry system. The trigger and cooperating strobe are selected to synchronize with the noise cycle. Strobe increments can be in units of degrees or in units of time, depending upon the source of the cyclic noise.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

FIG. 4 illustrates the response of an electromagnetic MWD telemetry system with no data transmission and no drill string rotation, data transmission and no drill string rotation, and data transmission and drill string rotation;

FIG. 5 is a cyclical noise signature for a strobe increment of 720 degrees;

FIG. 6 is a fast Fourier transform of an algebraic summation of increment composite noise signals for the noise signature shown in FIG. 5;

FIG. 8 is a fast Fourier transform of the fast Fourier transform cyclical noise "signature" component shown in FIG. 6 subtracted from the fast Fourier transform composite signal R shown in FIG. 7.

DETAILED DESCRIPTION OF THE PREFERRED EMBODIMENTS

This present invention is directed toward apparatus and methods for minimizing cyclical noise in an electromagnetic (EM) borehole telemetry system. As discussed previously, the methodology of the invention has widespread applications. For purposes of discussion, the invention will be disclosed as a system for removing cyclical noise from an MWD system comprising an electromagnetic telemetry system. More specifically, apparatus and methods for removal of cyclical noise resulting from the rotation of the rotary table or top drive of a drilling rig will be presented in detail.

Figure 1:
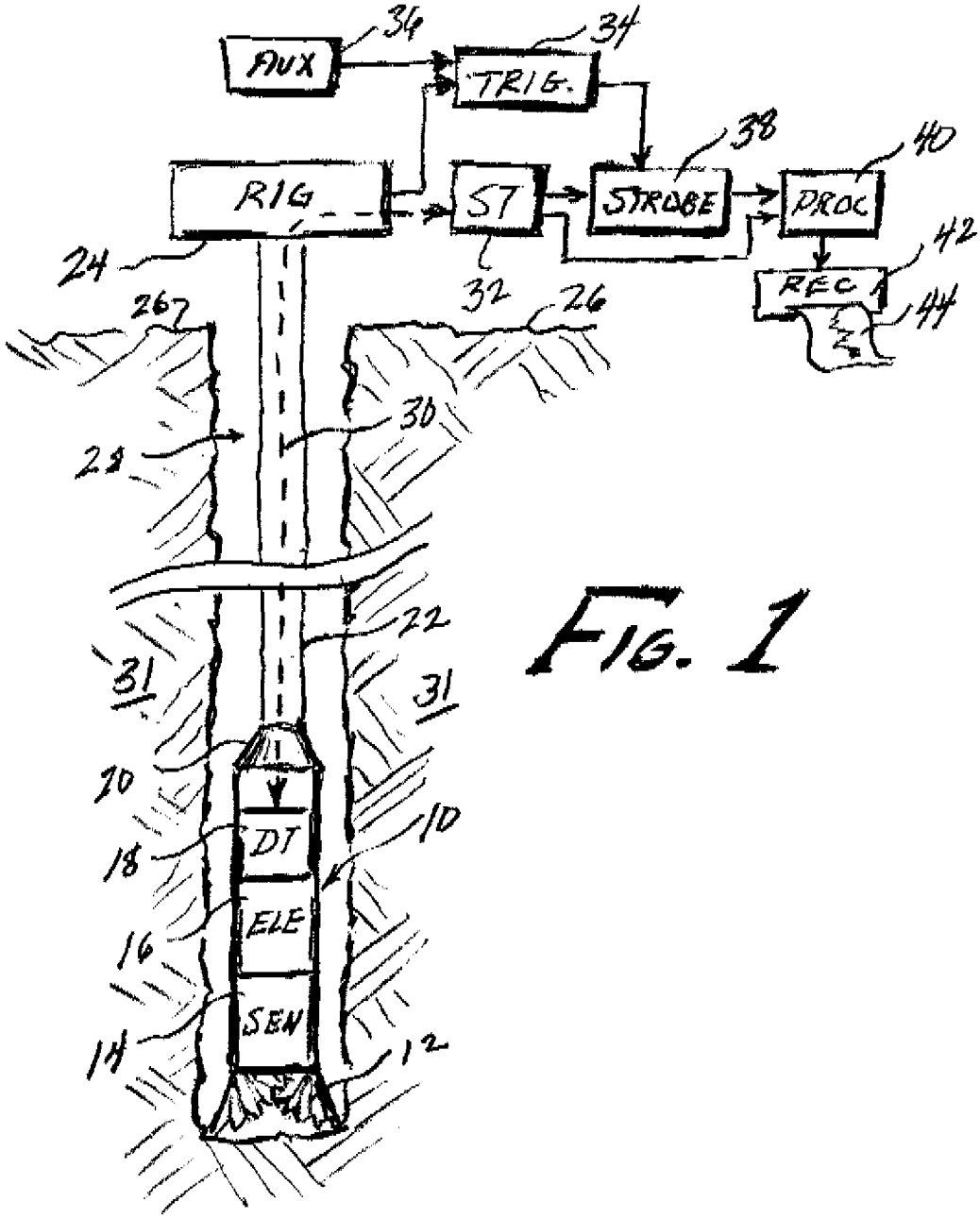
FIG. 1 is a conceptual illustration of the basic elements of the invention embodied as a MWD system.

FIG. 1 is a conceptual illustration of the invention embodied in a MWD logging system comprising a borehole assembly 10 operating within a borehole 28 that penetrates earth formation 31. The borehole assembly 10 is operationally attached to a drill string 22 by means of a connector 20. The upper end of the drill string 22 terminates at a rotary drilling rig 24, which is well known in the art and illustrated conceptually at 24 for brevity and simplicity.

Still referring to FIG. 1, the borehole assembly 10 comprises a sensor package 14 comprising one or more sensors. The one or more sensors are preferably responsive to the formation and borehole environs. The sensor package 14 is preferably powered and controlled by an electronics package 16. The electronics package 16 cooperates with the sensor package to provide a signal to a downhole transceiver 18. The signal is indicative of the response of the one or more sensors comprising the sensor package 14. The downhole transceiver 18 communicates electromagnetically with a surface transceiver 32 disposed preferably at or near the surface 26 of the earth. Communication can be two-way.

The downhole transceiver 18 and the surface transceiver 32 depicted in FIG. 1 are elements of the MWD electromagnetic telemetry system. Electromagnetic signals are modulated according to the response of the sensor package 14 to represent one or more parameters of interest. Various embodiments can be used to telemeter signals between the downhole transmitter 18 and the surface transmitter 32. In one embodiment, signals are transmitted from the downhole transceiver 18, through intervening earth formation 32, and detected as a voltage or a current by the surface transceiver 32. Examples of this type of telemetry system is disclosed in U.S. Pat. Nos. 4,684,946 and 6,628,206, and are entered into this disclosure by reference. In another embodiment, the downhole transceiver 18 creates a current within the drill string 22, and the current travels to the surface along the drill string. This current is typically created by imposing a voltage across a non-conducting section (not shown) in the borehole assembly 10. Again, electromagnetic signals are modulated according to the response of the sensor package 14 to represent one or more parameters of interest. A voltage between the drilling rig 24 and a remote ground (not shown) is generated by the current and is measured by a surface transceiver 32. One or more parameters of interest are extracted from the measured voltage. Alternately, the one or more parameters of interest can be extracted from a measure of current. An example of this type of telemetry system is disclosed in U.S. Pat. No. 4,001,774, and is entered into this disclosure by reference Again referring to FIG. 1, communication between the downhole transceiver 18 and the surface transceiver 32 is illustrated conceptually by the broken line 30. This broken line illustration emphasizes that the apparatus and methods of the present invention are not dependent upon a specific type of electromagnetic telemetry system.

Synchronous time averaging (STA) is used to identify cyclical noise in an electromagnetic telemetry response. This response typically includes noise comprising cyclical and non cyclical noise components. The cyclical and non cyclical noise will hereafter be referred as the "composite" noise signal. A strobe is triggered by a cooperating trigger to sense, during a "strobe increment", a plurality of increment composite noise signals. These increment composite noise signals are algebraically summed. Any non cyclical noise occurring in the increment composite noise signals, measured during the strobe increment, algebraically cancels in the algebraic summing operation. Conversely, any cyclical noise occurring during the strobe increment and in synchronization with the strobe increment will be algebraically summed. The result of the trigger-strobe-summing methodology is a "signature or" "picture" of any cyclical noise component occurring synchronously with the predetermined strobe increment. This noise component is then combined with the measured composite telemetry system response to remove, or to at least minimize, the cyclical noise. This, in turn, maximizes the signal to noise ratio of the electromagnetic telemetry system.

FIG. 1 illustrates a trigger 34 and a strobe 38 cooperating with the drilling rig 24, and more particularly with an element such as the rotary table or top drive (neither shown) of the drilling rig. A rotary table will be used for purposes of illustration and discussion. A "strobe increment" is initiated or "triggered" and subsequently terminated by the rotational passage of stimuli comprising predetermined azimuth points on the rotary table. The stimuli can comprise a switch, a reflector, a magnet, or any suitable means to operate the trigger and cooperating strobe. Stimuli configured as azimuth points will be illustrated in detail in FIGS. 2*a*-2*c* and related discussion. Alternately, these azimuth points can be defined on the drill string 22 extending above the surface 26 of the earth. Embodied as shown, the strobe increment is in degrees. A telemetry system response received by the surface transceiver 32. This response, which comprises a "signal" component representative of the response of the sensor package 14 and a composite noise component. The telemetry system response received at the surface will hereafter be referred as the "composite" signal. The composite signal is measured preferably during the plurality of strobe increments and stored in a processor 40. The increment composite noise signals discussed above are algebraically summed in the processor 40. As discussed above, any non cyclical noise (or signal) occurring during and synchronous with the strobe increment algebraically cancels in the algebraic summing operation. Any cyclical noise occurring during the predetermined strobe increment, and in synchronization with the strobe increment, will be enhanced by the algebraic. This yields, within the processor 40, a signature or picture of any cyclical noise component occurring synchronously with the predetermined strobe increment. The composite signal from the surface transceiver 32 is simultaneously input directly into the processor 40, as shown conceptually in FIG. 1. The noise cyclic noise signature is then combined with the measured composite signal, within the processor 40, to remove cyclical noise from the composite response of the telemetry system. This, in turn, maximizes the signal to noise ratio of the electromagnetic telemetry system. The result of this combination is a signal representative of the response of the sensor package 14 with a maximized signal to noise ratio. The signal is then converted, preferably within the processor 40, into one or more parameters of interest. These results are typically output to a recorder 42 as a function of depth within the borehole 22 thereby forming a record of the one or more parameters in a form commonly known as a "log".

It should be recalled that the strobe 38 can be triggered by stimuli other than predetermined azimuth points on a rotating element of the drilling rig including a rotary table, a top drive or protruding drill string sections. As an example, a clock can be used to generate stimuli signals to define strobe increments to measure noise resulting from pumps, motors, overhead power lines and the like. This capability is illustrated conceptually in FIG. 1 as an "auxiliary" input 36 cooperating with the trigger 34.

Data Processing

The synchronous time averaging technique can be implement using a variety of mathematical formalism with essentially the same end results of cyclical noise removal from a composite electromagnetic signal. The following formalism is, therefore, used to illustrate basic concepts, but other formalisms within the framework of the basic concepts may be equally effective.

As discussed previously, the telemetered electromagnetic composite signal "R", represented conceptually by the broken line 30 in FIG. 1, comprises a signal component "S" representative of the response of the sensor package 14 and a composite noise component "N". Stated mathematically, $$R=S+N \tag{1}$$

The strobe is triggered by the cooperating trigger to record, during a strobe increment, a plurality "j" of increment composite noise signals "$e_i$". These composite noise signals are algebraically summed initially as $$N=\Sigma_i e_i.\ (i=j, \ldots, k) \tag{2}$$

If k−j is sufficiently large, any non cyclical noise component occurring during the strobe increments algebraically cancels in the algebraic summing of N. Any cyclical noise component occurring during the strobe increments, and in synchronization with the strobe increments, is enhanced by the algebraic summing of N. Equation (2) yields, therefore, a signature or picture of any cyclical noise component of N occurring synchronously with the predetermined strobe increment. This cyclical noise component is then combined with the composite signal R, measured preferably in coincidence with the increment composite noise signals $e_i$ (and thus N), to determine the quantity of interest S. The parameter S is the telemetered signal with the cyclical noise removed, and indicative of the response of the sensor package 14. A variety of methods can be used to combine the composite signal R and the measure of N including semblance and least squares fitting techniques. For purposes of illustration, a simple subtraction $$S=R-N \tag{3}$$

is used to illustrate the determination of S, the signal component of interest. This process removes, or to at least minimize, the cyclical noise component thereby increasing the signal to noise ratio of the electromagnetic telemetry system.

Figure 2A:
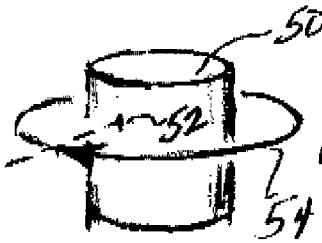
FIG. 2*a* depicts a strobe increment of 360 degrees.
Figure 2B:
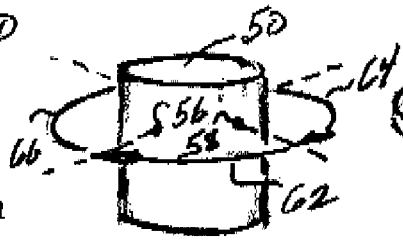
FIG. 2*b* depicts strobe increments of 90 degrees.
Figure 2C:
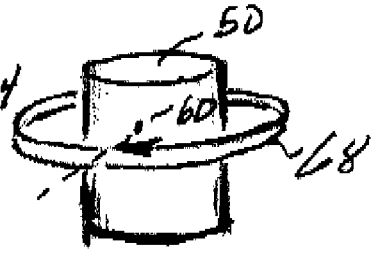
FIG. 2*c* depicts a strobe increment of 720 degrees.

FIGS. 2*a*, 2*b* and 2*c* illustrates conceptually three strobe increments $g_i$ related to determining cyclical noise generated by a rotating element of a drilling rig such as a rotary table. In this case, increment composite signals $e_i$ are measured during strobe increments $g_i$ defined in units of degrees of rotation. The rotary table (or top drive) is represented conceptually by the cylinder 50 in FIGS. 2*a*-2*c*. It should be understood that the cylinder 50 can also represent essentially any other rotating element of a drilling rig assembly. In FIG. 2*a*, only a single predetermined azimuth point is shown at 52. The resulting strobe increment $g_i$=360 degrees is illustrates conceptually by the arrow 54. In FIG. 2*b* two of four predetermined azimuth points are shown at 56 and 58 resulting in strobe increments $g_i$=90 degrees, as partially illustrated by the arrows 62, 64 and 66. In FIG. 2*c*, again only a single predetermined azimuth point is shown at 60, but the strobe increment $g_i$ is 720 degrees as indicated by the arrow 68. Strobe increments do not necessarily need to be equal or need to be contiguous. Using the mathematical formalism discussed above, the choice of strobe increment may necessitate the normalization of the noise component N expressed mathematically in equation (2). That is $$N'=KN, \tag{4}$$

N' is a normalized noise component and K is a multiplicative normalization factor. For the strobe increment shown in FIG. 2*a*, K=1. For the strobe increments shown in FIG. 2*b*, K=4. Finally, for the strobe increment shown in FIG. 2*c*, K=0.50. The corresponding relationship for the signal component is then $$S=R-N' \tag{5}$$

Figure 3:
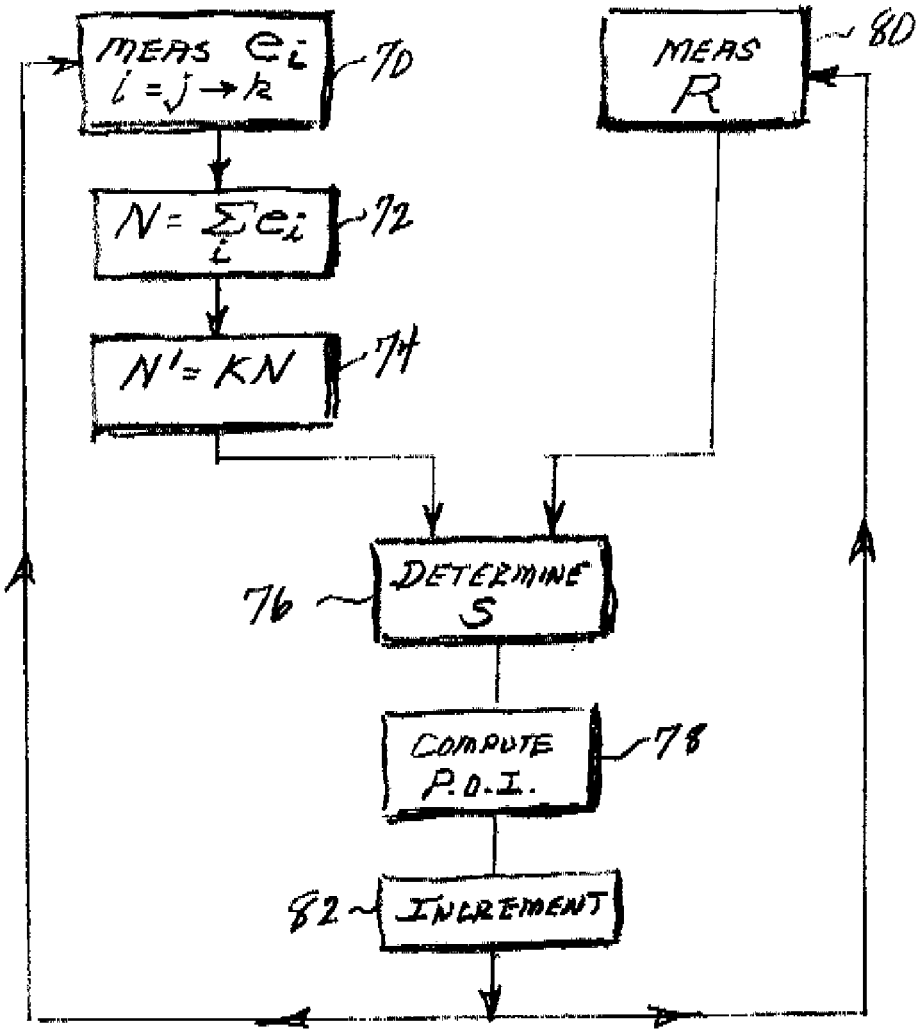
FIG. 3 is a conceptual flow chart of one embodiment of STA system for minimizing cyclical noise in an EM telemetry system.

FIG. 3 is a simplified flow chart illustrating how the concept of synchronous time averaging is used in a telemetry system to minimize cyclical noise and to generate "logs" of parameters of interest as a function of borehole depth. Alternately, embodied as a telemetry system for well monitoring apparatus, logs of parameters of interest are usually presented as a function of time. Increment composite noise signals $e_i$ are measured at 70. Preferably, the composite signal R is simultaneously measured at 80. The noise component N is computed at 72 according to equation (2). A normalized noise component N' is computed at 74 according to equation (4). The components R and N' are combined at 76 to determine the signal component S according to equation (5). The signal component S is then used to compute at least one parameter of interest at 78 using a predetermined relationship, wherein the predetermined relationship is preferably resident in the processor 40. The procedure is incremented in depth at 82 if the system is a MWD logging system, and the previously described steps are repeated at a new depth. If the system is a well monitoring system, the procedure is incremented at 82 in time and the previously described steps are likewise repeated.

Results

FIG. 4 illustrates the measured response of a MWD electromagnetic telemetry system by a surface transceiver 32 (see FIG. 1). The illustration is a plot of received information (in Volts) as a function of time (in seconds). It should be understood that the response is oscillatory. Only the "envelope" 90 of the response, defined by an upper limit curve 92 and a lower limit curve 94, is shown for clarity of illustration. The oscillatory nature of the measured information will be shown in a subsequent illustration.

Again referring to FIG. 4, the portion of the envelope 90 identified at 92 illustrates the telemetry system response with no data transmission and no rotation of the drill string. At a time identified by 102, signal transmission from the borehole assembly is initiated resulting in an increase in the magnitude of the response measured at the surface transceiver 32. At a time identified by 104, the action of the rotary table initiates rotation of the drill string. The magnitude of the response measured at the surface transceiver 32 further increases by typically cyclical electromagnetic noise produced by the rotation of the rotary table or other rotating elements of the drilling rig. FIG. 4 is, therefore, presented to illustrate the cyclical noise produced by a rotary drilling rig, and the significance of this noise in reducing the signal to noise ratio measured at the surface transceiver 32 of the electromagnetic telemetry system.

FIG. 5 illustrates a single increment composite noise signal $e_i$ measured over a strobe increment comprising an arc of $g_i$=720 degrees (see FIG. 2*c*). This strobe increment constitutes, of course, two revolutions of the rotary table as illustrated conceptually by the broken line 112 at 360 degrees. This response can contain both cyclical and non cyclical noise components. The oscillatory nature of the of the output of the surface transceiver 32 in shown in the curve 110, which is a plot of an increment composite noise signals $e_i$ in volts (ordinate) as a function of degrees of rotary table rotation (abscissa).

The results of cyclical noise reduction are best shown using fast Fourier transforms (FFT) of the various STA steps disclosed above.

FIG. 6 shows a curve 114 representing a fast Fourier transform (FFT) of a summation of increment composite noise signals of the form shown in FIG. 5. Stated another way, FIG. 6 represent the previously discussed "picture" or "signature" of the cyclical noise components in the frequency domain. The summation is expressed mathematically in equation (2). The ordinate is relative power and the abscissa is frequency in units of Hertz. It is apparent that multiple cyclical noise frequencies are present, as illustrated by the multiple power peak structure.

Figure 7:
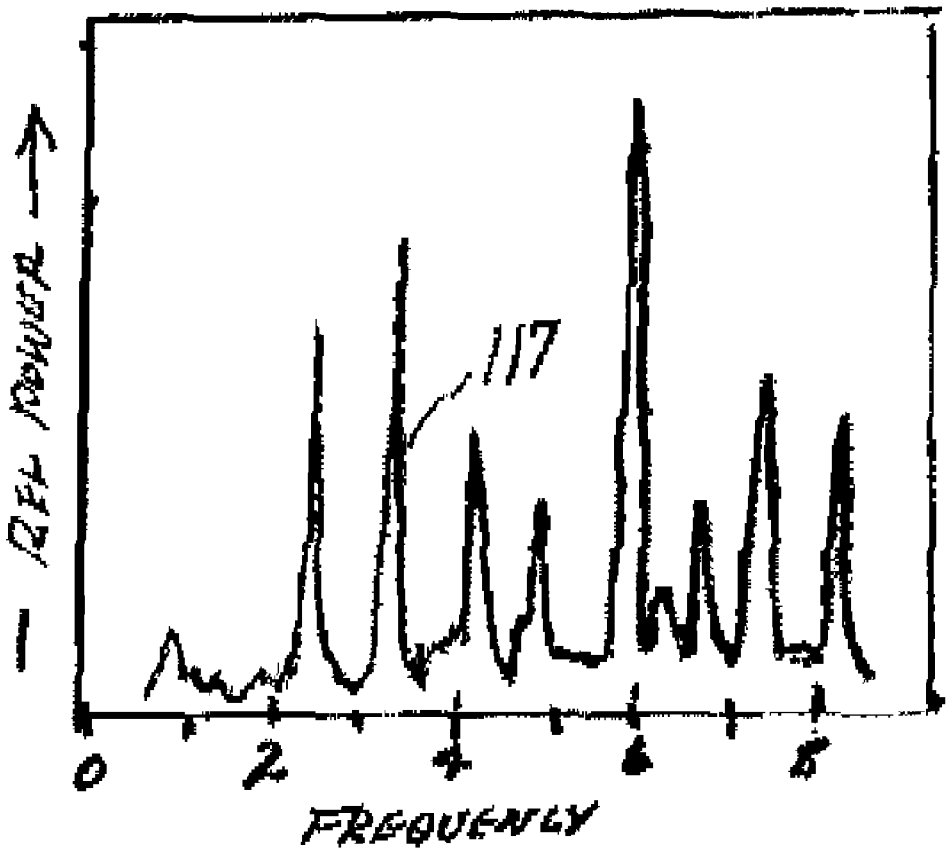
FIG. 7 is a fast Fourier transform of the composite signal R measured by the surface transceiver.

FIG. 7 shows a curve 117 representing a FFT of the composite signal R output from the surface transceiver 32. The composite signal R comprises both a signal component S and a noise component N, as expressed mathematically in equation (1). Again, the multiple power peak structure indicates multiple cyclical noise frequencies as well as a signal frequency, as will be seen in the following illustration.

FIG. 8 is a FFT of the cyclical noise "signature" component shown in FIG. 6 subtracted from the FFT of the composite signal R shown in FIG. 7. This step is expressed mathematically in equations (3) or (5), depending upon required normalization. The signal representing the response of the sensor package 14 shown in FIG. 1 is represented by the peak 120 at a frequency identified at 118. The peaks 116 of lower power represent non cyclical noise or noise not synchronous with the predetermined strobe increments.

In comparing FIG. 8 with FIG. 7, it is apparent that cyclical noise has been significantly reduced thereby enhancing the signal to noise ratio of the electromagnetic telemetry system and, in turn, improving accuracy and precision of any parameters of interest derived from the signal.

While the foregoing disclosure is directed toward the preferred embodiments of the invention, the scope of the invention is defined by the claims, which follow.

The invention claimed is:

1. An electromagnetic telemetry system comprising:
(a) a surface transceiver for measuring a composite signal;
(b) a trigger sensitive to a stimulus and cooperating with a strobe to define a plurality of strobe increments; and
(c) a processor cooperating with said surface transceiver
(i) to algebraically sum increment composite noise signals measured during said plurality of strobe increments to define a cyclical noise component, and
(ii) to combine said cyclical noise component with said composite signal to obtain a signal component.

2. The electromagnetic telemetry system of claim 1 wherein said stimulus comprises a predetermined azimuth point on a rotating element.

3. The electromagnetic telemetry system of claim 1 wherein said stimulus comprises a signal generated by a clock.

4. A method for determining a signal component contained within a composite electromagnetic signal, the method comprising the steps of:
(a) measuring said composite signal;
(b) defining a plurality of strobe increments with a trigger sensitive to a stimulus and cooperating with a strobe;
(c) measuring, during said plurality of strobe increments, increment composite noise signals;
(d) summing algebraically said increment composite noise signals to define a cyclical noise component; and
(e) combining said cyclical noise component with said composite signal to obtain said signal component.

5. The method of claim 4 comprising the additional step of defining said stimulus as a predetermined azimuth point on a rotating element.

6. The method of claim 4 comprising the additional step of defining said stimulus as signal generated by a clock.

7. An MWD logging system comprising:
(a) a downhole electromagnetic transceiver for transmitting a signal component from a downhole sensor;
(b) a surface electromagnetic transceiver for measuring a composite signal comprising said signal component;
(c) a trigger responsive to an azimuth point on a rotating element of a drilling rig and cooperating with a strobe to define a plurality of strobe increments; and
(d) a processor cooperating with said surface transceiver
(i) to algebraically sum increment composite noise signals measured during said plurality of strobe increments to define a cyclical noise component, and
(ii) to combine said cyclical noise component with said composite signal to obtain said signal component.

8. The logging system of claim 7 wherein said cyclical noise component is normalized as a function of said definition of said plurality of said strobe increments.

9. The logging system of claim 7 further comprising a predetermined relationship for converting said signal component into a parameter of interest.

10. The logging system of claim 9 further comprising a recorder cooperating with said processor to generate a log of said parameter of interest.

11. A method for determining a parameter of interest while drilling a borehole, the method comprising the steps of:
(a) transmitting, with a downhole electromagnetic transceiver, a signal component from a downhole sensor;
(b) receiving, with an electromagnetic surface transceiver, a composite signal comprising said signal component;
(c) defining a plurality of strobe increments with a trigger responsive to an azimuth point on a rotating element of a drilling rig and cooperating with a strobe; and
(d) algebraically summing increment composite noise signals measured during said plurality of strobe increments to define a cyclical noise component;
(e) combining said cyclical noise component with said composite signal to obtain said signal component; and
(f) converting said signal component into said parameter of interest using a predetermined relation.

12. The method of claim 11 comprising the additional step of normalizing said cyclical noise component as a function of said definition of said plurality of said strobe increments.

13. The method of claim 11 further comprising the step of generating a log of said parameter of interest.

14. The method of claim 11 wherein said strobe increment comprise equal arcs.

15. The method of claim 11 wherein said strobe increments are contiguous.

* * * * *

UNITED STATES PATENT AND TRADEMARK OFFICE

CERTIFICATE OF CORRECTION

PATENT NO. : 7,609,169 B2
APPLICATION NO. : 11/468868
DATED : October 27, 2009
INVENTOR(S) : Robert Anthony Aiello It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 680 days.

Signed and Sealed this

Twelfth Day of October, 2010

David J. Kappos

David J. Kappos
*Director of the United States Patent and Trademark Office*